US008341965B2

(12) United States Patent
Price et al.

(10) Patent No.: US 8,341,965 B2
(45) Date of Patent: Jan. 1, 2013

(54) METHOD AND SYSTEM FOR COOLING

(75) Inventors: Donald C. Price, Dallas, TX (US); William Gerald Wyatt, Plano, TX (US); Gary J. Schwartz, Dallas, TX (US)

(73) Assignee: Raytheon Company, Waltham, MA (US)

( * ) Notice: Subject to any disclaimer, the term of this patent is extended or adjusted under 35 U.S.C. 154(b) by 2453 days.

(21) Appl. No.: 10/876,789

(22) Filed: Jun. 24, 2004

(65) Prior Publication Data

US 2005/0284153 A1 Dec. 29, 2005

(51) Int. Cl.
*F25B 21/02* (2006.01)
*F28F 3/12* (2006.01)
*G02B 5/08* (2006.01)

(52) U.S. Cl. ..... 62/3.2; 165/168; 359/845

(58) Field of Classification Search ..... 62/3.7, 62/3.2; 359/845; 165/168, 169, 170
See application file for complete search history.

(56) References Cited

U.S. PATENT DOCUMENTS

| | | | | |
|---|---|---|---|---|
| 2,321,964 A | | 6/1943 | Zieber | |
| 3,131,548 A | | 5/1964 | Chubb et al. | |
| 3,174,540 A | | 3/1965 | Dutton | |
| 3,371,298 A | | 2/1968 | Narbut | |
| 3,586,101 A | | 6/1971 | Chu et al. | 165/101 |
| 3,609,991 A | | 10/1971 | Chu et al. | |
| 3,731,992 A | * | 5/1973 | Mansell | 359/845 |
| 3,756,903 A | | 9/1973 | Jones | |
| 3,774,677 A | | 11/1973 | Antonetti et al. | 165/39 |
| 3,989,102 A | | 11/1976 | Jaster et al. | 165/107 |
| 4,003,213 A | | 1/1977 | Cox | 62/124 |
| 4,019,098 A | | 4/1977 | McCready et al. | 361/385 |
| 4,330,033 A | | 5/1982 | Okada et al. | 165/104.27 |
| 4,357,077 A | * | 11/1982 | Yevick | 359/633 |
| 4,381,817 A | | 5/1983 | Brigida et al. | 165/110 |
| 4,495,988 A | | 1/1985 | Grossman | 165/96 |
| 4,511,376 A | | 4/1985 | Coury | 55/36 |
| 4,561,775 A | * | 12/1985 | Patrick et al. | 356/5.04 |
| 4,569,591 A | * | 2/1986 | Ford et al. | 356/153 |
| 4,733,961 A | * | 3/1988 | Mooney | 356/5.08 |
| 4,794,984 A | | 1/1989 | Lin | 165/133 |
| 4,851,856 A | | 7/1989 | Altoz | 343/720 |
| 4,938,280 A | | 7/1990 | Clark | 165/80.4 |
| 4,945,980 A | | 8/1990 | Umezawa | 165/101 |
| 4,993,487 A | | 2/1991 | Niggemann | 165/164 |
| 4,998,181 A | | 3/1991 | Haws et al. | 361/385 |
| 5,128,689 A | | 7/1992 | Wong et al. | 343/853 |
| 5,148,859 A | | 9/1992 | Beamer | 165/41 |

(Continued)

FOREIGN PATENT DOCUMENTS

DE GB 1220952 3/1968

(Continued)

OTHER PUBLICATIONS

Pgs. 59 and 80 of "*Willis Haviland Carrier Father of Air Conditioning*", Margaret Ingels, Country Life Press—Garden City (1952).

(Continued)

*Primary Examiner* — Frantz Jules
*Assistant Examiner* — Cassey D Bauer

(57) ABSTRACT

A method for cooling a structure includes flowing a saturated refrigerant through one or more passageways in the structure while maintaining the refrigerant at a substantially constant pressure. The method also includes evaporating at least a portion of the refrigerant at a substantially constant temperature throughout the passageways in the structure.

26 Claims, 3 Drawing Sheets

U.S. PATENT DOCUMENTS

| | | | | | |
|---|---|---|---|---|---|
| 5,161,610 | A | | 11/1992 | Leidinger | 165/41 |
| 5,168,919 | A | | 12/1992 | Berenholz et al. | 165/80.4 |
| 5,209,291 | A | * | 5/1993 | Taylor | 165/168 |
| 5,239,443 | A | | 8/1993 | Fehey et al. | 361/689 |
| 5,261,246 | A | | 11/1993 | Blackmon et al. | 62/85 |
| 5,276,319 | A | * | 1/1994 | Hepfer et al. | 250/208.1 |
| 5,317,395 | A | * | 5/1994 | Carr et al. | 348/164 |
| 5,333,677 | A | | 8/1994 | Molivadas | 165/32 |
| 5,361,587 | A | * | 11/1994 | Hoffman | 62/3.2 |
| 5,493,305 | A | | 2/1996 | Wooldridge et al. | 342/368 |
| 5,501,082 | A | | 3/1996 | Tachibana et al. | 62/149 |
| 5,515,690 | A | | 5/1996 | Blackmon et al. | 62/85 |
| 5,648,868 | A | * | 7/1997 | Hall et al. | 359/364 |
| 5,818,692 | A | | 10/1998 | Denney, Jr. et al. | 361/699 |
| 5,841,564 | A | | 11/1998 | McDunn et al. | 359/161 |
| 5,910,160 | A | | 6/1999 | Cakmakci et al. | 62/195 |
| 5,943,211 | A | | 8/1999 | Havey et al. | 361/699 |
| 5,960,861 | A | | 10/1999 | Price et al. | 165/80.3 |
| 6,018,192 | A | | 1/2000 | Root et al. | 257/714 |
| 6,055,154 | A | | 4/2000 | Azar | 361/688 |
| 6,292,364 | B1 | | 9/2001 | Fitzgerald et al. | 361/699 |
| 6,297,775 | B1 | | 10/2001 | Haws et al. | 343/700 |
| 6,498,725 | B2 | | 12/2002 | Cole et al. | 361/700 |
| 6,519,955 | B2 | | 2/2003 | Marsala | 62/119 |
| 6,588,647 | B2 | | 7/2003 | Yamada et al. | 228/112.1 |
| 6,679,081 | B2 | | 1/2004 | Marsala | 62/259.2 |
| 6,878,677 | B1 | * | 4/2005 | Sakanoue et al. | 508/433 |
| 6,957,550 | B2 | * | 10/2005 | Wyatt et al. | 62/475 |
| 6,972,950 | B1 | * | 12/2005 | Wyatt et al. | 361/687 |
| 7,000,691 | B1 | * | 2/2006 | Weber | 165/281 |
| 2003/0188538 | A1 | | 10/2003 | Chu et al. | 62/3.2 |
| 2003/0218800 | A1 | * | 11/2003 | Khurana et al. | 359/368 |
| 2004/0023419 | A1 | * | 2/2004 | Kishkovich et al. | 438/7 |
| 2004/0065850 | A1 | * | 4/2004 | Kane | 250/495.1 |

FOREIGN PATENT DOCUMENTS

| | | | |
|---|---|---|---|
| EP | 0 243 239 | A2 | 4/1987 |
| EP | 02 51 836 | A1 | 5/1987 |
| EP | 0 817 263 | A2 | 10/1991 |
| EP | 0 817 263 | A2 | 1/1998 |
| EP | 1 143 778 | A1 | 3/2001 |
| EP | 1 380 799 | A2 | 5/2003 |
| EP | 1 380 799 | A2 | 7/2003 |
| WO | WO 00/65890 | | 2/2000 |
| WO | WO 02/23966 | A2 | 3/2002 |

OTHER PUBLICATIONS

PCT Notification of Transmittal of the International Search Report or the Declaration dated Sep. 27, 2004 for PCT/US2004/015086.

Dirk Van Orshoven, "*The use of water as refrigerant—an exploratory investigation*", Thesis at the University of Wisconsin-Madison, XP-002121470 (pp. I, III-XIII, pp. 114) 1991.

EPO Search Report dated Oct. 25, 2004 for Patent No. 03254283.9-2203; Reference No. JL3846.

EPO Search Report dated Nov. 3, 2004 for Patent No. 03254285.4-2301; Reference No. JL3847.

U.S. Appl. No. 10/853,038, filed May 25, 2004 by inventors Richard M. Weber, et al. for "Method and Apparatus for Controlling Cooling with Coolant at a Subambient Pressure", 25 pages of text and 4 drawing sheets.

European Search Report for Int'l Application No. EP 05 25 3902 (Raytheon Company); Place of Search: Munich; 2 pp., Dec. 11, 2006.

European Patent Office, Munich, Germany, Summons to Attend Oral Proceedings Pursuant to Rule 115(1) EPC, Application No. 05253902.0-2301/1610077, Ref: JL5332 dated Jul. 12, 2009 (3 pgs), Dec. 7, 2009.

* cited by examiner

METHOD AND SYSTEM FOR COOLING

TECHNICAL FIELD OF THE INVENTION

This invention relates generally to heat transfer and more particularly to a method and system for cooling.

BACKGROUND OF THE INVENTION

The need to cool certain structure arises in many applications. In particular applications, it is desired to cool a structure to a substantially uniform and relatively low temperature. One example of such an application is cooling of the optical elements in a forward looking infrared radar (FLIR) turret. Such devices are often maintained at relatively high temperatures while waiting to be used, due to the ambient environment. However, it is often desirable to cool these optical elements to a temperature on the order of −50° C. during operation. Further, it is desirable that this temperature be relatively uniform throughout the optical elements to avoid deformation in the element and any associated degradation in the optical performance of the optical element. Other structural devices may also need to be cooled to a relatively low and uniform temperature, such as electronic devices.

Conventional approaches at cooling elements in a FLIR turret have involved blowing air either over the optical element or through passageways within the optical element. This approach may be useful in certain instances; however, when the desired temperature to which the optical element is to be cooled is less than the ambient air, such an approach will not be satisfactory. Further, non-uniform temperature distributions may result as the air being blown over the optical element is partially heated by the optical element.

SUMMARY OF THE INVENTION

According to one embodiment of the invention a method for cooling a structure includes flowing a saturated refrigerant through one or more passageways in the structure while maintaining the refrigerant at a substantially constant pressure. The method also includes evaporating at least a portion of the refrigerant at a substantially constant temperature throughout the passageways in the structure.

Embodiments of the invention provide numerous technical advantages. Some embodiments may benefit from some, none, or all of these advantages. For example, according to one embodiment, a cooling system is provided that allows cooling of a structure to a very low temperature relatively quickly. A substantially uniform temperature distribution may be achieved in the structure. In addition, such cooling may take place without the use of complicated high pressure lines. In some embodiments, cooling may occur without the use of expensive vapor cycle cooling systems. Further, such cooling systems may be cheaper than conventional vapor cycle cooling systems. In addition, in one embodiment, cooling may be achieved in a relatively efficient manner for a transient load condition because the amount of heat rejected by this system may vary by appropriate control of associated thermoelectric heat exchanger. The above-described advantages may also be achieved through the use of relatively small flow rates and liquid lines.

Other advantages may be readily apparent to one of skill in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1 through 5 of the drawings, like numerals being used for like and corresponding parts of the various drawings.

Figure 1:
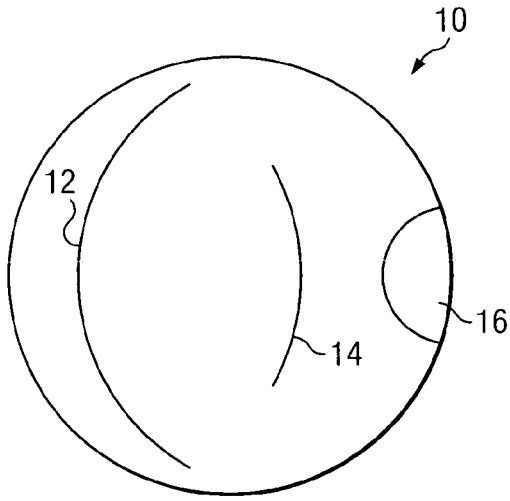
FIG. 1 is a schematic diagram illustrating a FLIR turret having an optical element to be cooled according to the teachings of the invention.

FIG. 1 illustrates a forward looking infrared radar (FLIR) turret 10. FLIR turret 10 includes a plurality of optical elements 12 and 14 for receiving infrared radiation through a window 16 and redirecting and/or focusing the infrared energy to a desired point. FLIR turret 10 is illustrated as having two optical elements 12 and 14; however, any suitable number of optical elements may be used. Further, although the teachings of the invention are described in the context of a cooling system for FLIR turret 10, any structure for which cooling is desired may be suitable for cooling according to the teachings of the invention.

As described above, it has been determined that it may be desirable to cool optical elements 12 and 14 to very low temperatures, such as −50° C., when in use. Conventionally, FLIR turret 10 would be hung from the lower side of an airplane when in use. Optical elements 12 and 14 are cooled to this temperature after having been stored at temperatures ranging up to 70° C. This high temperature is often achieved through storing the FLIR turret 10 in a hot ambient environment. In some applications it is important that optical elements 12 and 14 are cooled uniformly so these elements are not distorted, which could affect the operation of FLIR turret 10.

Hanging from an airplane flying at a high altitude and being exposed to ambient air provides an opportunity for cooling optical elements 12 and 14 by exposing it to the ambient air; however, the ambient air at typical flying altitudes is not cool enough to cool optical elements 12 and 14 to the desired temperature. Further, the teachings of the invention recognize that using a circulating fluid in a vapor cycle that contacts optical elements 12 and 14 may not be a suitable solution. This arises for a number of reasons. First, many typical fluids would freeze at such a low temperature. In addition, large flow rates would be required to bring the temperature of optical elements 12 and 14 down to −50° C. in a rapid timeframe. In addition, because of its location of being hung from the bottom of an aircraft, a complicated flowpath including large lines that must be insulated would be required. In addition, because of the desire to cool optical elements 12 and 14 uniformly such that significant temperature gradients do not arise, the use of liquid that contact portions of optical elements 12 and 14 would likely not be suitable because the fluid would not cool optical elements 12 and 14 uniformly. This is the case because as the fluid contacts the optical elements it warms, thus cooling later-contacted portions to a lesser degree than earlier-contacted portions. In addition, vapor cycle systems cool continuously, but in the above described application, the heat load is transient in nature. Once optical elements 12 and 14 are cooled to a desired temperature, much smaller amounts of energy input are required to maintain it at the desired temperature. Thus a vapor cycle system, which is designed to dissipate a constant amount of heat, would not work well. It should be emphasized here, however, that although the above-described reasons for using a cooling system according to the teachings of the invention apply to the context of FIG. 1, the cooling system according to the teachings of the invention may also be useful where these reasons do not apply.

Figure 4:
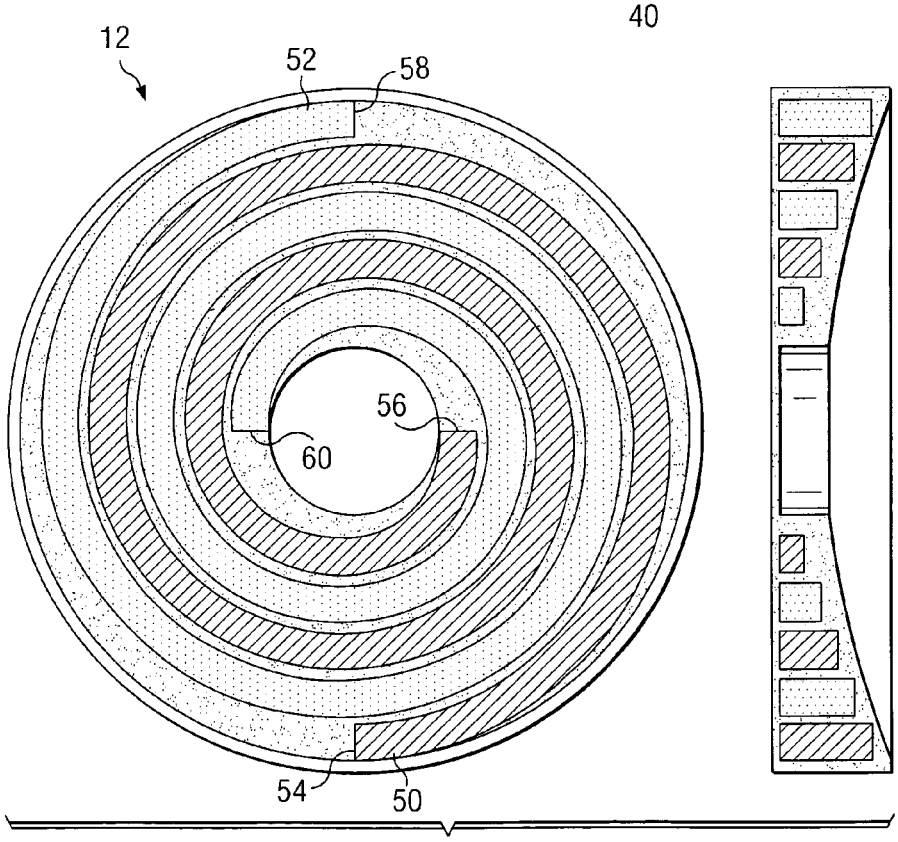
FIG. 4 is a block diagram illustrating a plurality of passageways in an optical element of the system of FIG. 1.

Thus, according to the teachings of the invention, a saturated refrigerant is provided within passageways in the optical elements 12 and 14 and are boiled as heat is transferred from optical elements 12 and 14 to the saturated refrigerant. (Example passageways are illustrated in FIG. 4). In one example, heat is removed from the vaporized refrigerant through a heat exchanger that exchanges heat with the ambient air temperature. In the particular context of FIG. 1, ram air, which is ambient air captured in the airstream outside an aircraft, which may be very low in temperature, on the order of −20° C., provides a good environment to dissipate heat. However, due to the desire to cool optical elements 12 and 14 to approximately −50° C., an active heat exchanger is utilized in one embodiment. This active heat exchanger may take the form of a conventional vapor cycle heat exchanger or alternatively, may incorporate thermoelectric elements. Thermoelectric elements are well-known devices that convert an electrical current into a temperature difference by virtue of the electrical characteristics of the material according to the Seebeck effect. Through boiling a saturated refrigerant within passageways of optical elements 12 and 14, a substantially uniform temperature distribution may be obtained because a saturated refrigerant vaporizes at a constant temperature. The teachings of the invention recognize that if a refrigerant is held at a constant pressure as it flows through the passageways in optical elements 12 and 14, the temperature at which the refrigerant vaporizes will remain constant, resulting in substantially uniform temperature over optical elements 12 and 14. As used herein, a substantially uniform temperature throughout or within optical elements 12 and 14 refers to the temperature distribution along the surface of contact of the refrigerant with optical elements 12 and 14, but recognizes that some thermal gradients will exist within the thickness of optical elements 12 and 14 and between parties not in contact with the passageways.

Although any suitable refrigerant may be used, one particularly suitable refrigerant may be R404A. In general, the better refrigerants are those that are conventionally used at low temperatures and low pressures. A further consideration is the magnitude of latent heat of vaporization. R404A, although having a latent heat of vaporization less than water and ethylene glycol, provides a relatively high latent heat of vaporization.

A particularly suitable embodiment involves the use of thermoelectric devices for the heat exchanger to condense the refrigerant that is vaporized while in the passageways of optical elements 12 and 14. The use of thermoelectric devices is likely cheaper than a vapor cycle heat exchanger due to at least in part to the expense of making such a vapor cycle exchanger both flightworthy and lightweight, as well as the low temperature, high pressure lines which would be required for a vapor cycle heat exchanger. In contrast, thermoelectric devices can easily operate at low pressures. Further, thermoelectric devices are particularly suited for transient environments, such as those in the environment of FIG. 1, in which optical elements 12 and 14 are cooled from an original high temperature down to a very low working temperature. At that point the amount of energy to be removed is far less than the amount of energy removed when optical elements 12 and 14 are at a much higher temperature. In such a case, the power of the thermoelectric devices, and thus the amount of heat removed by the heat exchanger, can be controlled by decreasing current to maintain optical elements 12 and 14 at a constant temperature. The use of thermoelectric devices as a condensing heat exchanger cuts against conventional wisdom because of the lower costs associated with using developed vapor cycle technology and the large amounts of power required for thermoelectric devices. Further, vapor cycle heat exchangers are likely to be more efficient.

Figure 2:
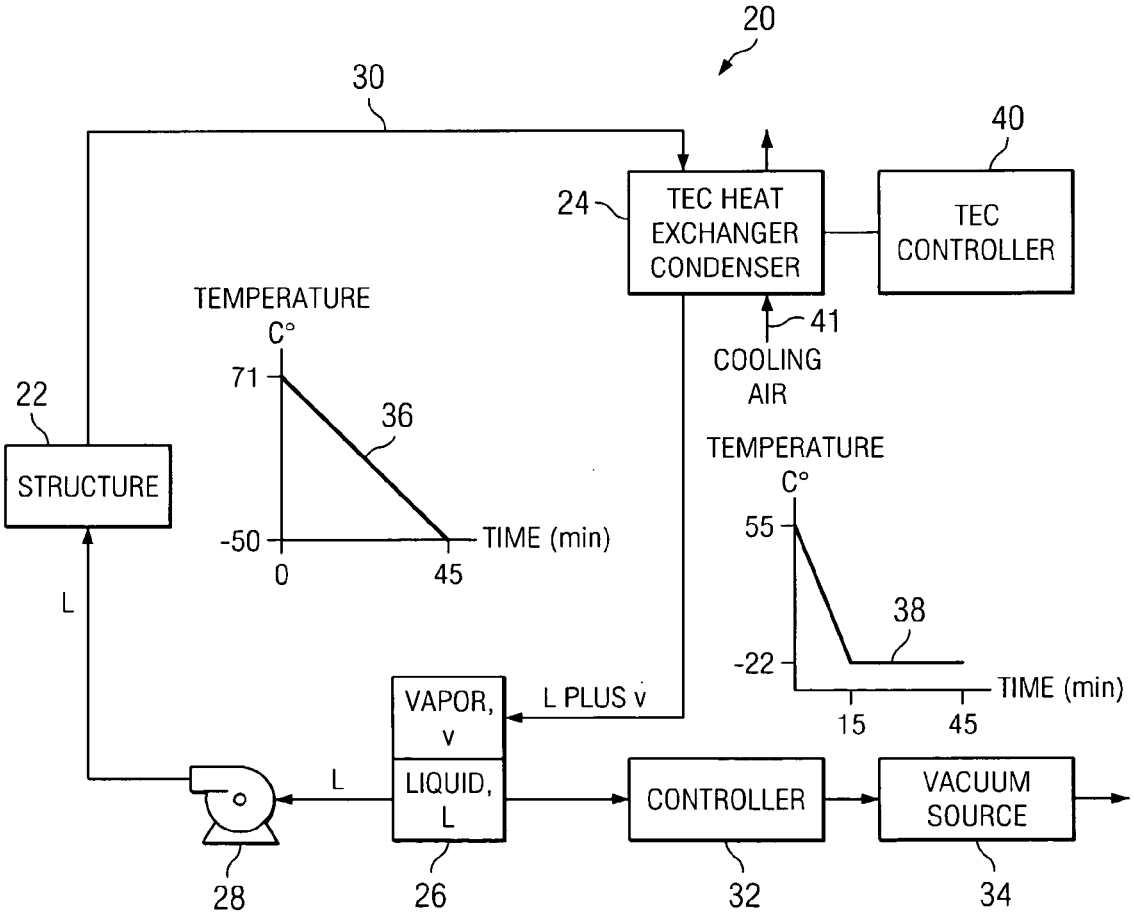
FIG. 2 is a block diagram illustrating an example cooling cycle for the system of FIG. 1 according to the teachings of the invention.

Additional details of one embodiment of the invention are described with respect to FIGS. 2 and 4.

FIG. 2 is a block diagram of a system 20 which includes a structure to be cooled 22, a heat exchanger 24, an accumulator 26, and a pump 28. These elements are arranged in a loop 30 in which refrigerant is circulated. Also illustrated are a controller 32 and a vacuum source 34 for initially charging the system 20. Also illustrated in FIG. 2 are graphs 36 and 38. Graph 36 is an example resulting temperature distribution of structure 22 as it is cooled by system 20. Graph 38 is one example of the temperature of cooling air 41 to which heat is rejected by heat exchanger 24. In this example, the cooling air cools down from 55° C. to −22° C., representing an assumed temperature versus time graph for ram air outside an aircraft between the time it is on the runway and the time it has reached a cruising altitude.

Pump 28 raises the pressure of a liquid refrigerant as it approaches structure 22. This pressure increase is provided such that a plurality of orifices (not explicitly shown) may be used to split the flow to one or more passages and one or more optical elements, such as optical elements 12 and 14. Again, it is emphasized that the invention is described in the context of the optical elements of FIG. 1; however, this cooling system 20 may be applied to any structure for which cooling is desired, whether or not involving optical elements. Since a pressure drop typically occurs through such orifices, pump 28 increases pressure to account for this pressure drop. In one example, the orifices are fed by a plenum and then the liquid refrigerant is provided through one or more passageways in structure 22. One example of passageways is illustrated in FIG. 4 in the example of optical elements 14 and 16. In that particular example, the liquid refrigerant comes into direct contact with the structure to be cooled; however, in other contexts, the liquid refrigerant may come into only thermal contact with the structure to be cooled.

Energy contained within structure 22 causes the liquid refrigerant, which is maintained at the refrigerant's saturation temperature and pressure, to boil resulting in significant heat transfer from structure 22 to the refrigerant. This results in rapid cooling of structure 22. If the refrigerant is appropriately selected, a large latent heat of vaporization exists, resulting in significant heat transfer. As described above, according to one embodiment the refrigerant is R404A; however, the general principal for refrigerants suitable for system 20 is that they are low temperature and low pressure refrigerants. The use of orifices allows the division of refrigerant flow to both a plurality of optical elements as well as a plurality of passageways within any given optical element.

Because the refrigerant is maintained at its saturation pressure, most of it is boiled as it passes through structure 22. However, some of the refrigerant remains in liquid form, which is desirable to ensure that the vapor is not superheated. Superheating of the vapor would result in increasing the temperature of the vapor. It is generally desirable to maintain the refrigerant at a constant temperature such that cooling of structure 22 occurs at a constant temperature. This results in a substantially uniform temperature distribution throughout structure 22. As described above in the context of FIG. 1, a substantially uniform temperature is desirable to avoid deformation in optical elements 12 and 14. Thus, superheating the vapor should be avoided.

A resulting mixture of vapor and liquid refrigerant is provided through loop 30 to heat exchanger 24. The heat exchanger 24 condenses the vapor as well as cools the liquid. The condensing of the vapor refrigerant forms the largest part of the heat exchange. Heat exchanger 24 also receives cooling air 41 from the ambient environment, which in one example is ram air at −22° C. Heat exchanger 24 may be a passive heat exchanger or an active heat exchanger. In the case of an active heat exchanger, heat exchanger may be a thermoelectric heat exchanger, a vapor cycle heat exchanger, or other suitable heat exchanger. In the case where heat exchanger 24 is an active heat exchanger, cooling air 41 may be at a temperature that is greater than the temperature to which structure 22 is cooled.

In the example in which heat exchanger 24 is a thermoelectric heat exchanger, controller 40 may be provided. Controller 40 controls the current to thermoelectric elements within the exchanger 24 such that refrigerant 30 is maintained at the appropriate temperature. As structure 22 begins to cool, less and less heat is required to be exchanged, and the amount of power to the thermoelectric elements may be reduced. As described above, because heat loads in such an environment are transient, a thermoelectric heat exchanger is particularly suited to this application.

The condensed liquid is sent to accumulator 26, which separates any vapor refrigerant from the liquid refrigerant. The liquid refrigerant is then pumped by pump 28 to structure 22 as described above.

Controller 32 and vacuum source 34 are used to ensure that there is both liquid and vapor in loop 30, which in turn ensures the refrigerant is at its saturation pressure and temperature. Controller 32 and vacuum source 34 function primarily upon initialization of system 20. With most refrigerants this initialization may take at least two forms. In one, system 20 is completely filled with liquid refrigerant before some liquid is sucked off. The other approach involves evacuating system 20 before bleeding some liquid into it.

Figure 3:
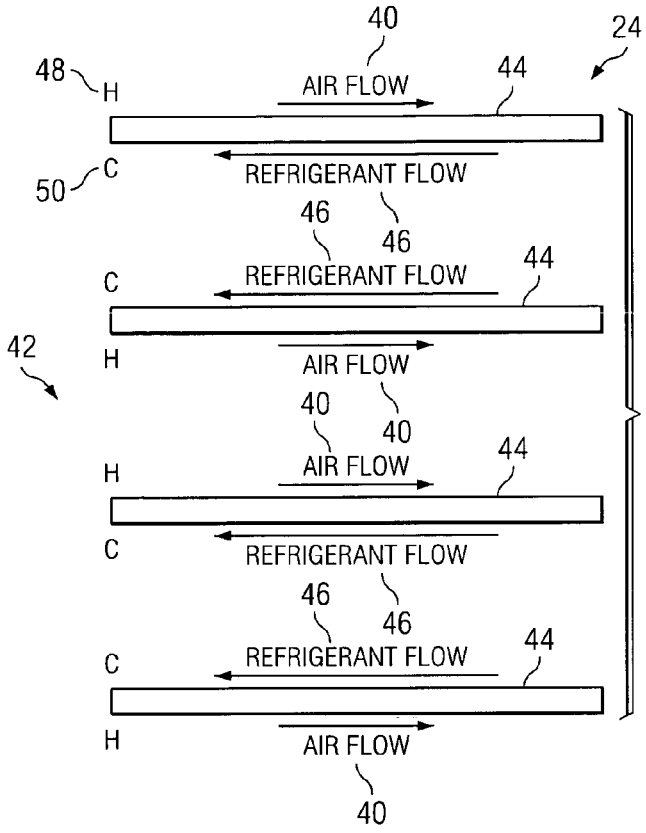
FIG. 3 is a schematic diagram of an example thermoelectric heat exchanger of the heat exchanger of FIG. 2.

FIG. 3 is a schematic diagram of an example thermoelectric heat exchanger according to the teachings of the invention. In this example, heat exchanger 24 includes a plurality of layers 42 of thermoelectric elements 44. In one example, four layers of sixteen elements each is utilized; however, any suitable number and combination of thermoelectric elements 44 may be used as desired for the particular application. Thermoelectric elements 44 has a hot side 48 and a cold side 50. The ram air 41 flows along hot side 48 and the saturated refrigerant 46 in primarily vapor form flows along cold side 50. The refrigerant 46 is then condensed and the heat is rejected to airflow 41.

The use of a thermoelectric element 44 further increases the amount of temperature drop between the hot side and cold side and allows rejection of more heat than would be possible using a common cold plate. In particular, the use of a thermoelectric device allows rejection of heat at a temperature that is greater than the heat to which structure 22 is cooled. The hot side 48 of thermoelectric elements 44 may be provided with finstock or cast fins to provide enhanced heat transfer. A suitable height and pitch may be designed for a particular purpose and based upon the flow rates of available air 41. The cold side 50 may also be provided with fins to separate the top and bottom layers to provide open flow areas. As described above, the cold side removes heat from refrigerant 46 and rejects it to the hot side 48 of thermoelectric element 44.

FIG. 4 is a schematic diagram of one example of a plurality of passageways formed in optical element 12 of FIG. 1. Illustrated are passageways 50 and 52. Passageway 50 has an outlet 54 and an inlet 56 for allowing the flow of refrigerant through passageway 50. Passageway 52 has an outlet 58 and an inlet 60 for allowing the flow of refrigerant through passageway 54. Although one example of passageways is illustrated, any suitable passageways may be utilized that results in a uniform enough temperature distribution for the desired purpose. By providing such a plurality of passageways, a relatively uniform temperature distribution may be achieved for components of structure 22 and allow cooling of structure 22 to a desired temperature.

Figure 5:
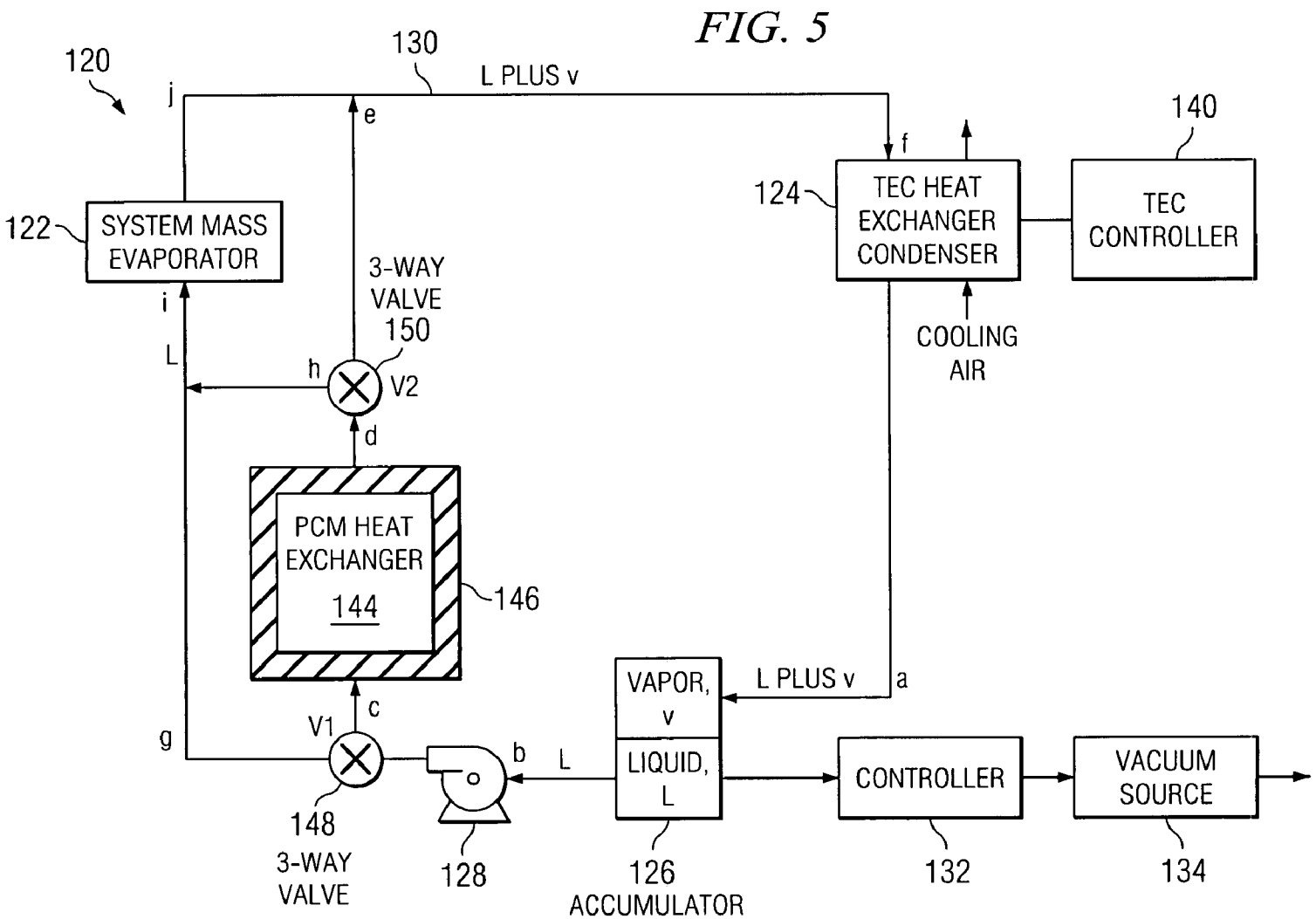
FIG. 5 is a block diagram illustrating another example cooling cycle for the system of FIG. 1 according to the teachings of the invention.

FIG. 5 is a block diagram illustrating an alternative cooling system 120 according to the teachings of the invention. System 120 includes many of the same elements of system 20 and are illustrated with similar corresponding reference numerals (such as controller 132, vacuum source 134, and controller 140). In addition to the elements illustrated in both FIGS. 2 and 5, system 120 includes a heat exchanger 144, a three-way valve 148 and a second three-way valve 150. Heat exchanger 144 may have a layer of insulation 146 wrapped around it.

In this embodiment, there are three cooling loops provided. A pre-cooling loop is the loop connecting the points a-b-c-d-e-f; a boost loop is the loop connecting points a-b-c-d-h-i-j-e-f; and a low-temperature loop is the node connecting points a-b-g-i-j-e-f. Initially, the pre-cooling loop passes the cold refrigerant from heat exchanger 124 through the accumulator 126 and through pump 128 to three-way valve 148. Valve 148 is positioned to divert the flow to heat exchanger 144. Heat exchanger 144 exchanges heat between a phase change material and the refrigerant in loop 130. The chilled refrigerant cools, solidifies, and then sub-cools the phase change material to a low temperature. One example of a suitable phase change material is a paraffin. The phase change material may be tailored to melt at a pre-specified temperature. Refrigerant then passes to three-way valve 150 and returns to the heat-exchanger 124 through points e and f.

Upon command of a controller, three-way valve 150 then diverts the flow of the refrigerant to structure 122, providing instant cooling capability to the system mass. The refrigerant then passes from structure 122 and returns exchanger 124 via points e and f. This cooling loop is known as the boost loop.

A sensor may identify the point at which the minimum temperature is reached by the boost loop and use three-way valve 148 to divert the refrigerant flow from point c to point g, where it passes directly to the system mass for cooling to the lowest temperatures. The flow then passes through structure 122 to point j and on to heat exchanger 124 through points 3 and f, this is known as the low temperature loop.

By using a boost loop, cooling system 120 allows precooling of a thermal mass associated with heat exchanger 144, which in turns allows more rapid cooling of structure 122 than would occur without the precooling. This provides the capability of using time periods in which heat exchanger 124 could not operate (such as when an associated airplane in on the runway, in the example of FIG. 1), to nevertheless begin the cooling process, resulting in reaching the desired temperature of structure 122 earlier than would it would otherwise.

Although the present invention and its advantages have been described in detail, it should be understood that various changes, substitutions, and alterations can be made therein without departing from the spirit and scope of the invention as defined by the appended claims.

What is claimed is:

1. A method comprising:

flowing a saturated refrigerant through multiple passageways in an optical element; and evaporating at least a portion of the refrigerant within the passageways to remove heat from the optical element;

wherein the passageways comprise first and second spiral passageways, the first and second spiral passageways interleaved moving from a center of the optical element outward towards an outer periphery of the optical element wherein each of the first and second spiral passageways has a variable height that increases as that spiral passageway approaches the outer periphery of the optical element.

2. The method of claim 1, further comprising:

circulating the refrigerant in a loop that includes the passageways.

3. The method of claim 1, further comprising:

condensing at least a portion of the evaporated refrigerant using a heat exchanger.

4. The method of claim 3, wherein the heat exchanger comprises at least one thermoelectric element.

5. The method of claim 1, wherein:

flowing the saturated refrigerant through the passageways comprises flowing the saturated refrigerant through the passageways at a substantially constant pressure; and evaporating at least the portion of the refrigerant comprises evaporating at least the portion of the refrigerant at a substantially constant temperature.

6. The method of claim 1, wherein flowing the saturated refrigerant through the passageways results in a substantially uniform temperature distribution throughout the optical element.

7. The method of claim 1, wherein:

the first and second spiral passageways have inlets on opposite sides of the optical element; and the first and second spiral passageways have outlets on opposite sides of the optical element.

8. The method of claim 1, wherein the optical element comprises an optical element in a forward looking infrared radar turret.

9. An apparatus comprising:

an optical element; and multiple passageways through the optical element, the passageways configured to receive a saturated refrigerant and to transport at least a portion of the refrigerant that vaporizes;

wherein the passageways comprise first and second spiral passageways, the first and second spiral passageways interleaved moving from a center of the optical element outward towards an outer periphery of the optical element wherein each of the first and second spiral passageways has a variable height that increases at that spiral passageway approaches the outer periphery of the optical element.

10. The apparatus of claim 9, further comprising:

a heat exchanger configured to condense the vaporized refrigerant.

11. The apparatus of claim 10, wherein the heat exchanger comprises at least one thermoelectric element.

12. The apparatus of claim 11, further comprising:

a controller configured to control the at least one thermoelectric element to maintain the optical element at a desired temperature.

13. The apparatus of claim 10, wherein the heat exchanger comprises a vapor cycle heat exchanger.

14. The apparatus of claim 10, further comprising:

a second heat exchanger configured to cool the refrigerant.

15. The apparatus of claim 14, further comprising:

at least one valve configured to remove the second heat exchanger from a cooling loop in which the refrigerant flows.

16. The apparatus of claim 9, wherein the optical element comprises an optical element in a forward looking infrared radar turret.

17. The apparatus of claim 9, wherein:

the first and second spiral passageways have inlets on opposite sides of the optical element; and the first and second spiral passageways have outlets on opposite sides of the optical element.

18. The apparatus of claim 9, wherein the first and second spiral passageways are not located within a central portion of the optical element.

19. A system comprising:

a radar turret comprising a window and multiple optical elements;

wherein each optical element comprises multiple passageways through that optical element, the passageways configured to receive a saturated refrigerant and to transport at least a portion of the refrigerant that vaporizes; and wherein each optical element comprises first and second spiral passageways interleaved moving from a center of that optical element outward towards an outer periphery of that optical element wherein each of the first and second spiral passageways in each optical element has a variable height that increases as that spiral passageway approaches the outer periphery of its associated optical element.

20. The system of claim 19, further comprising:

a heat exchanger configured to condense the vaporized refrigerant.

21. The system of claim 20, wherein the heat exchanger comprises at least one thermoelectric element.

22. The system of claim 21, further comprising:

a controller configured to control the at least one thermoelectric element.

23. The system of claim 20, wherein the heat exchanger comprises a vapor cycle heat exchanger.

24. The system claim 20, further comprising:

a second heat exchanger configured to cool the refrigerant.

25. The system of claim 24, further comprising:

at least one valve configured to remove the second heat exchanger from a cooling loop in which the refrigerant flows.

26. The system of claim 19, wherein:

the first and second spiral passageways in each optical element have inlets on opposite sides of that optical element; and the first and second spiral passageways in each optical element have outlets on opposite sides of that optical element.

* * * * *